United States Patent [19]

Driska

[11] Patent Number: 5,029,861

[45] Date of Patent: Jul. 9, 1991

[54] KIT FOR TABLE GAME

[75] Inventor: John J. Driska, Princeton Junction, N.J.

[73] Assignee: Azrak-Hamway International Inc., New York, N.Y.

[21] Appl. No.: 447,571

[22] Filed: Dec. 7, 1989

[51] Int. Cl.[5] ..... A63F 7/07

[52] U.S. Cl. ..... 273/85 A; 273/126 A; 273/127 R; 273/119 A

[58] Field of Search ..... 273/118 R, 119 R, 123 R, 273/126 R, 126 A, 127 R, 85 R, 119 A; 273/129 V, 85 A, 121 A, 121 R, 85 B, 85 F

[56] References Cited

U.S. PATENT DOCUMENTS

| | | | |
|---|---|---|---|
| 1,377,364 | 5/1921 | Quinn | 273/119 R |
| 1,510,949 | 10/1924 | McKinnon | 273/119 R |
| 2,083,119 | 6/1937 | Hense | 273/119 R |
| 2,182,418 | 12/1939 | Williams | 273/121 A |
| 2,464,261 | 3/1949 | Ripley | 273/85 A |
| 2,830,819 | 4/1958 | Pearl | 273/121 A |
| 2,872,193 | 2/1959 | Hamilton | 273/129 V |
| 3,466,042 | 9/1969 | Lucci | 273/85 A |
| 3,643,954 | 2/1972 | Meyer | 273/129 V |
| 3,854,724 | 12/1974 | Abraham | 273/125 R |
| 3,976,296 | 8/1976 | Smith | 273/85 A |
| 4,061,334 | 12/1977 | Kanno | 273/126 A |
| 4,136,871 | 1/1979 | Meyers et al. | 273/85 A |
| 4,239,219 | 12/1980 | Haefliger | 273/127 R X |
| 4,248,427 | 2/1981 | Vierimaa | 273/125 R X |
| 4,269,413 | 5/1981 | Langieri | 273/121 R |
| 4,620,706 | 11/1986 | Ijidakinro | 273/127 R X |
| 4,773,646 | 9/1988 | Joos et al. | 273/127 R X |
| 4,917,383 | 4/1990 | Brown et al. | 273/118 R |

FOREIGN PATENT DOCUMENTS

| | | | |
|---|---|---|---|
| 1329027 | 4/1963 | France | 273/85 A |
| 1433560 | 2/1966 | France | 273/119 R |
| 1489138 | 6/1967 | France | 273/85 A |
| 381521 | 10/1932 | United Kingdom | 273/119 R |
| 1131596 | 10/1967 | United Kingdom . | |

*Primary Examiner*—Edward M. Coven
*Assistant Examiner*—Sebastiano Passaniti
*Attorney, Agent, or Firm*—Amster, Rothstein & Ebenstein

[57] ABSTRACT

A kit comprises in combination a table game component and at least one other component removably positionable thereon. The table game component includes a playing surface defining an aperture therethrough, a rotatable drive disposed below the playing surface and accessible through the aperture, a game piece capable of moving over the playing surface, and a bat for engaging the game piece so as to cause it to move over the playing surface. The at least one other component is adapted to be removably positioned in the aperture and comprises a rotatable deflector having, when removably positioned in the aperture, a deflecting element of a given composition, size and configuration positioned above the playing surface for deflecting the movement of the game piece when the deflecting element contacts the game piece, and a driving element disposed below the playing surface for operatively engaging the rotatable drive for rotation therewith.

19 Claims, 7 Drawing Sheets

5A
5A
152'
150'
209
10
202'
202'
202'
18
204'
206
208
52
30
32
40
42
14
12
60
42
40
46
48
16
104
52
28
26
52
100
102
174
110
126
112
116
114
154'
122
128
124

202'
150'
102
209

FIG. 6
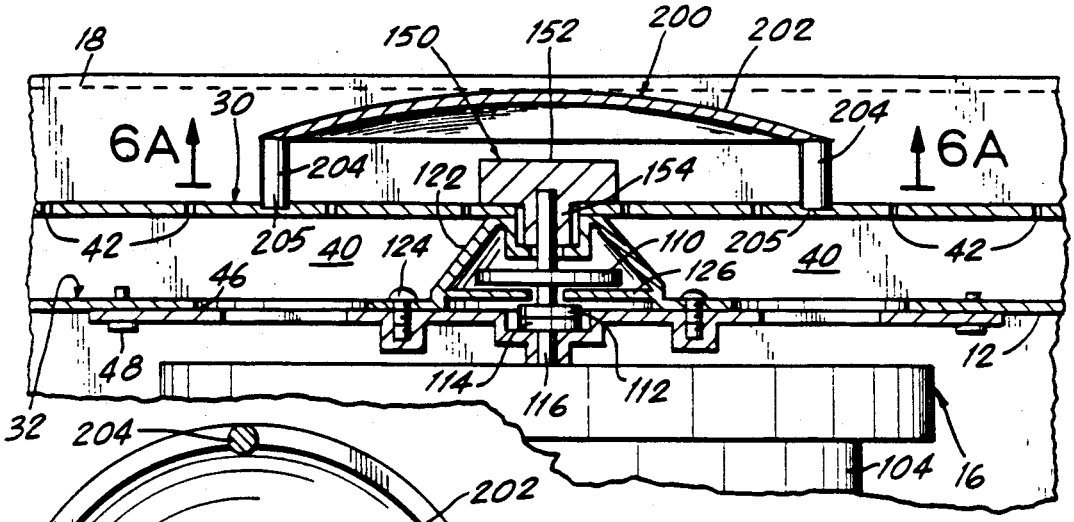
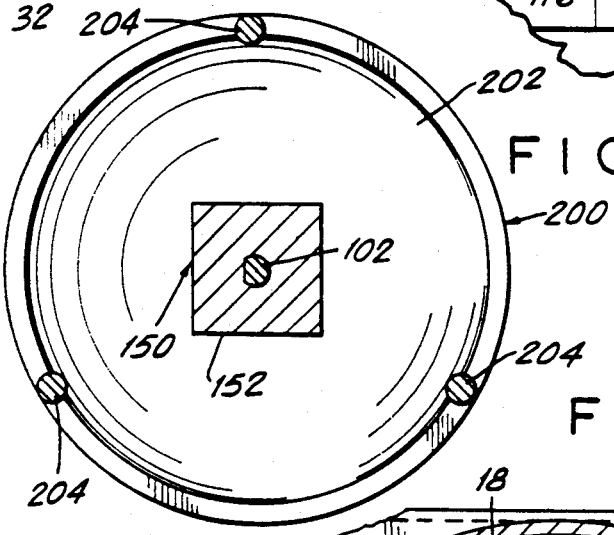
FIG. 6A
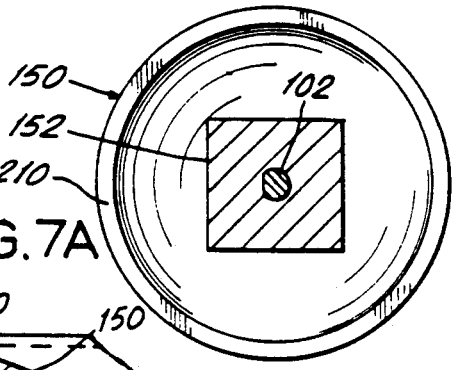
FIG. 7A
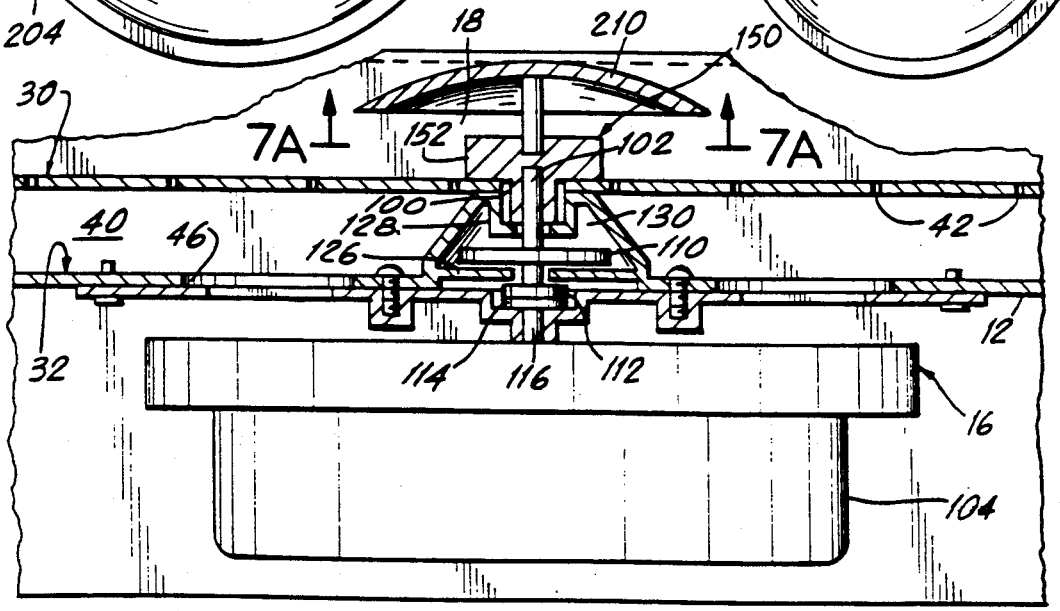
FIG. 7

KIT FOR TABLE GAME

BACKGROUND OF THE INVENTION

The present invention relates generally to kits for table games, and more particularly a kit for a table game having a spinning deflector.

It is well known to provide table games in which each opponent urges a projectile towards the opponent's goal and defends his own goal against entry by the projectile. It is also known to provide such a table game with a spinning deflector, typically located in the center of the playing area, which is independently powered so as not to be under the control of the players. While the players may avoid the spinning deflector by banking shots off any sideboards or bumper strips into the opponent's goal, any contact between the spinning deflector and the projectile introduces a random factor affecting the accuracy of the shot and possibly even returning the projectile to the shooter's own goal. The spinning deflector makes the game more challenging, even for one accomplished in the game, because it is typically positioned in the center of the playing area so as to preclude goal-to-goal direct line shots and requires either banking goal-to-goal shots or shots from the sidelines towards the opponent's goal. However, the games having a powered spinning deflector have not proven to be entirely satisfactory in use.

The games which the expert finds challenging and exciting are not suitable for use by the tyro who finds them too difficult and random and thus loses interest in them. On the other hand, those which the tyro finds challenging and exciting are boring and uninteresting to the expert. Thus, the need remains for a game appealing both to the tyro and the expert as well as those at various stages therebetween.

Accordingly, it is an object of the present invention to provide a kit for forming a table game in which there is a removable powered rotating deflector, so that the game may be played with or without the deflector.

Another object is to provide such a kit which may include a plurality of interchangeable components for varying the difficulty and randomness of the game.

A further object is to provide such a kit which may include plug means for providing a flush playing surface when the deflector has been removed from the game.

A final object is to provide such a game in which the removable component is concealed from the view of the players during normal play of the game, so as to add a further element of chance and mystery.

SUMMARY OF THE INVENTION

It has now been found that the above and related objects of the present invention are obtained in a kit comprising, in combination, a table game component and at least one other component removably positionable thereon.

The table game component includes a playing surface defining an aperture therethrough, and rotatable drive means disposed below the playing surface and accessible through the aperture. The table game component further includes a game piece capable of moving over the playing surface, and means for engaging the game piece so as to cause it to move over the playing surface. The other component is adapted to be removably positioned in the aperture and comprises rotatable deflector means. When removably positioned in the aperture, the rotatable deflector means includes a deflecting element of a first given composition, size and configuration positioned above the playing surface for deflecting the movement of the game piece when the deflecting element contacts the game piece, and a driving element disposed below the playing surface for operatively engaging the drive means for rotation therewith.

In a preferred embodiment the kit additionally includes as one of the other components, plug means having, when removably positioned in the aperture, a stationary top surface substantially flush with the playing surface. The kit preferably additionally includes as one of the other components, second deflector means similar to the first-mentioned deflector means but of a second given composition, size or configuration different from the first given composition, size or configuration.

The kit preferably additionally includes a concealing component comprising means for concealing the deflecting element from the view of the players during normal play of the game. The concealing means includes support means for removably positioning it over and about the deflecting element of the other component, when the other component is removably positioned in the aperture. The concealing component includes support means for removably supporting it either on the playing surface or above the Playing surface without contacting the Playing surface. Alternatively, the deflector means may additionally include concealing means positioned above and about the deflecting element of the deflector means, when the deflector means is removably positioned in the aperture, so as to conceal the deflecting element from the view of the players during normal play of the game.

In a particularly preferred embodiment the table game is an air cushion table game (such as air hockey) including an air bed having an upper surface defining the playing surface and means for creating an air cushion above the playing surface. The game piece has an area and weight such that it floats upon the air cushion during play and is capable of moving over the playing surface generally without touching it, and the engaging means engages the game piece so as to cause it to move upon the air cushion and over the playing surface. The means for creating an air cushion above the playing surface also comprises the drive means, the deflector means being rotated by the cushion-creating means through a mechanical clutch linkage.

BRIEF DESCRIPTION OF THE DRAWING

The above brief description, as well as further objects and features of the present invention will be more fully understood by reference to the following detailed iu description of the presently preferred, albeit illustrative, embodiments of the present invention when taken in conjunction with the accompanying drawing wherein:

FIG. 6 is a fragmentary sectional view of the game similar to FIG. 3 but with the first deflector and an alternate concealing member in place;

FIG. 6A is a sectional view of the first deflector and the alternate concealing member in place, taken along the line 6A—6A of FIG. 6;

FIG. 7 is a fragmentary sectional view, similar to FIG. 6, but with the deflector including a concealing portion;

FIG. 7A is a sectional view of the deflector including a concealing portion, taken along the lines 7A—7A of FIG. 7.

DETAILED DESCRIPTION OF THE PREFERRED EMBODIMENTS

The present invention will be described hereinafter in the context of an air hockey game generally, and more particularly the air hockey game described in my co-pending U.S. patent application Ser. No. 07/447,219, filed herewith. It will be appreciated, however, that the principles of the present invention are equally applicable to table games other than hockey, regardless of whether or not the projectile, ball or puck in such a game travels on an air cushion over a playing surface or directly upon the playing surface (that is, without an air cushion).

Prior to a consideration of the novel aspects of the present invention, the basic game described in my aforesaid co-pending patent application will be described as follows.

Figure 1:
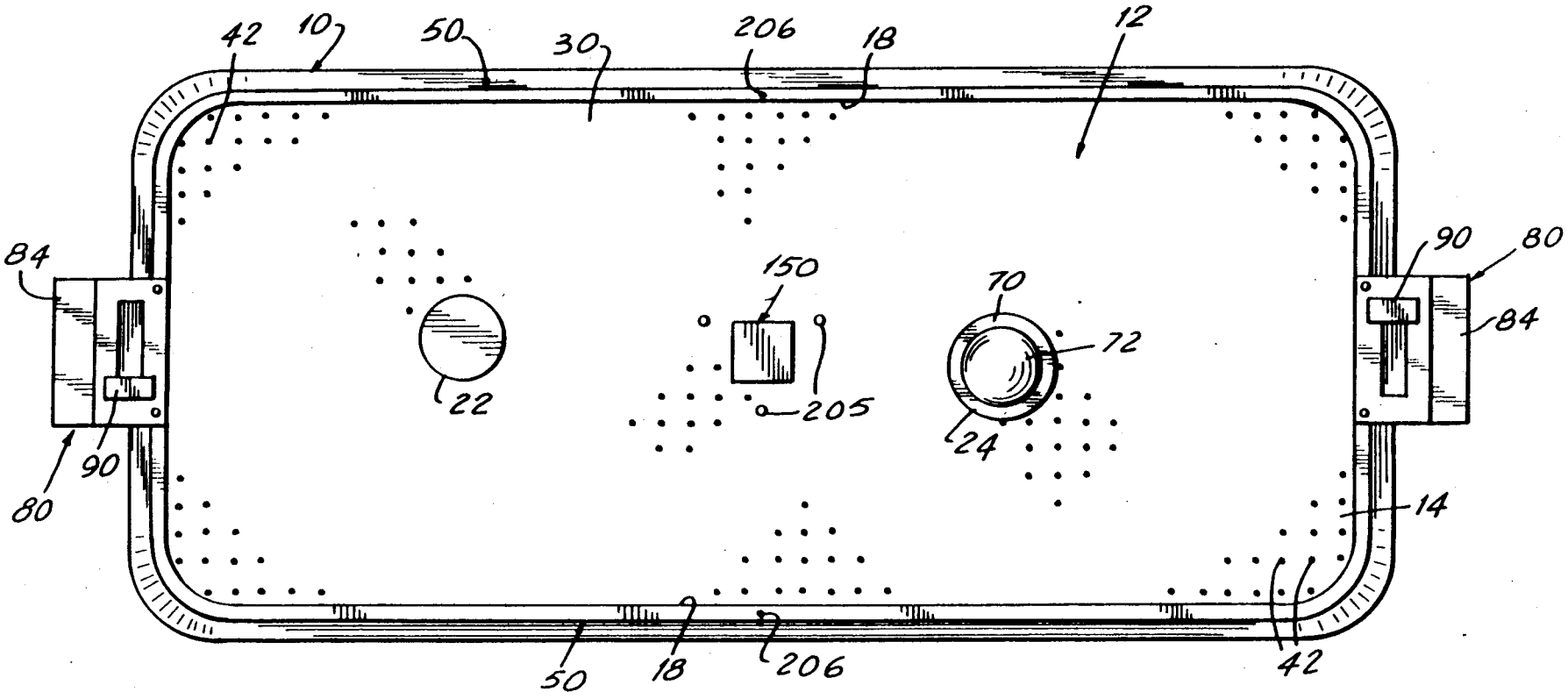
FIG. 1 is a top plan view of a table game formed from a kit according to the present invention with a first deflector in place.
Figure 2:
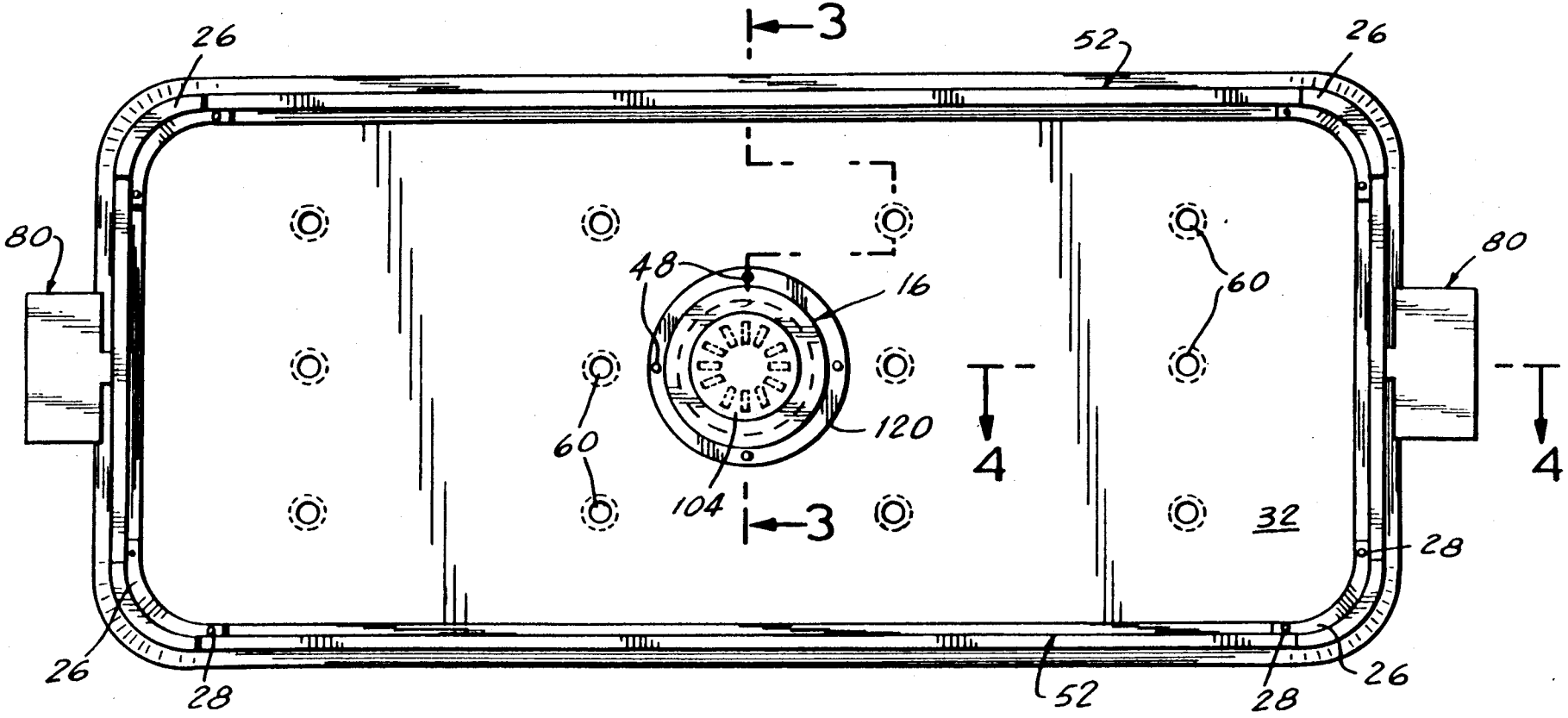
FIG. 2 is a bottom plan view of the game.

Referring now to the drawing, and in particular to FIGS. 1 and 2 thereof, therein illustrated is an air cushion table game generally designated by the reference numeral 10. In its conventional aspects the game comprises basically an air bed generally designated 12 having an upper surface defining a substantially flat playing surface 14, and means for creating an air cushion above the playing surface 14, such as a fan generally designated 16 (see FIG. 2). A bumper strip 18 defines a boundary of the playing surface 14 upon the air bed 12. A housing may be placed over the fan 16 for the purposes of appearance and noise abatement, a series of apertures in the fan housing being provided to insure a sufficient air supply to the fan intake.

The game is played with a game piece, such as a puck 22, having an area and weight such that it floats upon the air cushion during play and is capable of moving over the playing surface 14 generally without touching it. Means for engaging the game piece 22, such as a bat generally designated 24, are provided for each contestant so as to cause the game piece 22 to move upon the air cushion and over the playing surface 14. Typically goals generally designated 80 will be provided at opposite ends of the playing surface 14 with the contestants standing at opposite ends of the table 10 and attempting to score by knocking the puck 22 into the opponent3 s goal 80. Optionally an automatic scoring system is provided such that movement of the puck 22 into a player's goal (that is, the scoring of a goal) is clearly indicated—for example, by the flashing of a light—and, if desired, cumulative scores may be maintained on a toteboard or the like.

External legs 26 (which may be injection molded) are secured to the air bed 12 by screws 28 or other means in order to raise the playing surface 14 to an appropriate height, depending upon whether the legs 26 are to rest on a floor or a table top (as shown). Optionally each leg is independently adjustable in height to enable minor modifications in the height of the playing surface and to enable leveling of the playing surface.

Figure 3:
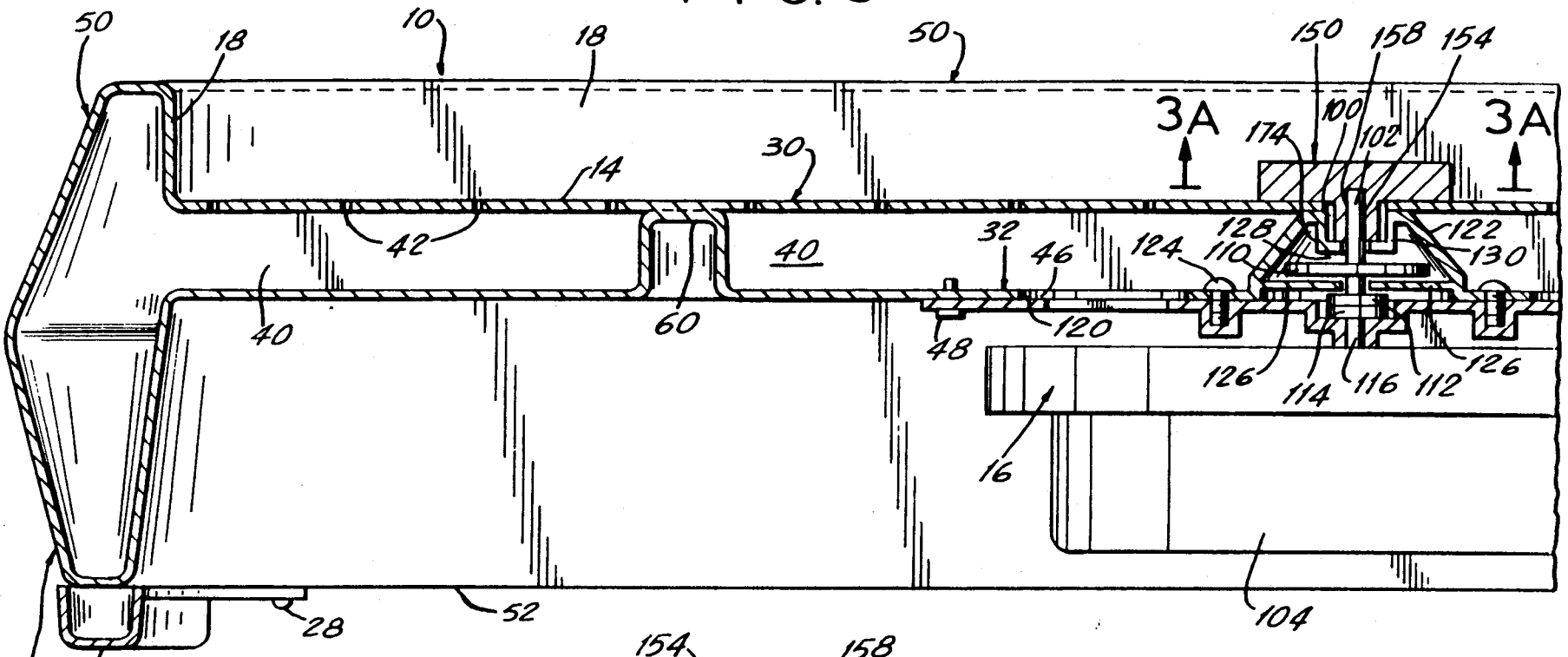
FIG. 3 is a fragmentary sectional view of the game, taken along the line 3—3 of FIG. 2.

As illustrated in FIG. 3, the air bed 12 comprises a top layer generally designated 30 and a bottom layer generally designated 32. The top and bottom layers 30, 32 are formed of the same blow-moldable plastic material, preferably a high density polyethylene, although other plastics such as polypropylene may also be used. The bottom layer 32 is disposed below and connected to the top layer 30 with the top and bottom layers 30, 32 defining a single plenum 40 extending therebetween.

More particularly, the top layer 30 defines a multiplicity of air jets or apertures 42 extending upwardly therethrough and arrayed in a substantially uniform pattern over the playing surface 14 to form the air cushion when air is blown through them from the plenum 40. Preferably the air jets 42 are about 0.040 inch in diameter and disposed on a 1"×1" grid (i.e., with the center points of the air jets 42 in a given row or column being spaced apart by about one inch). Each of the air jets 42 is in gaseous communication with the plenum 40 so that a build up of air pressure within the plenum 40 relative to the ambient atmosphere causes the air within the plenum 40 to exhaust upwardly through the multiplicity of air jets 42.

The bottom layer 32 has a duct or opening 46 therethrough communicating with the plenum 40. The fan 16 for creating an air cushion above the playing surface 14 is in gaseous communication with the duct 46 for forcing air therethrough, so that the air will enter the plenum 40 and eventually flow and exhaust upwardly through the air jets 42 to form the air cushion above the playing surface 14. For example, the housing of fan or blower 16 may be mounted by screws 48 to the bottom layer 32 in vertical alignment with duct 46. While the duct is illustrated as centrally disposed on the bottom layer 32, with the fan 16 thereunder, clearly the duct and fan may be in other locations as well.

The top layer 30 preferably defines along its periphery an inverted U-shaped curve 50, the inwardly-facing leg of which is operatively substantially vertically disposed to the playing surface 14 and constitutes the integral bumper strip 18. The bumper strip 18 extends vertically upwardly from the playing surface 14 to a height of approximately ¾ inch, the inner face thereof being smooth so that it does not exert any vertical forces upon a striking puck which could cause it to take off. The bottom layer 32 preferably defines along its 10 periphery a U-shaped curve 52 having a height of about 2½ inches and constituting an integral leg to which the external leg 26 may be secured. The outer legs of the curves 50, 52 meet at the free ends thereof so that the plenum or chamber 40 is air-tight except for the duct 46 in the bottom layer 32 and the air jets 42 in the top layer 30. To this end, screws 28, 48 and any others which pierce a surface of the plenum are provided with gaskets, sealers or the like (not shown) as necessary to effect an air-tight connection.

The bottom layer 32 is formed with a plurality of spaced apart, upwardly projecting integral lugs 60. The upper portions of lugs 60 are welded during the molding process to the bottom surface of the upper layer 30 intermediate the air jets 42 so as not to block the air jets 42 and so as to enable the single plenum 40 to feed each of the air jets 42. It will be appreciated that while the top layer curve 50 defining the integral sidewall or bumper strip 18 and the bottom layer curve 52 defining the integral leg serve to rigidify the air bed 12 generally, and the plenum 14 thereof specifically, the Projections 60 serving a supporting role in maintaining the desired spacing and juxtaposition of the top and bottom layers 30, 32 of the plenum 40. While the projections 60 are illustrated as cylindrical in cross section, clearly square, conical or other shape projections may be similarly employed. The projections 60 are preferably about ½ inch in diameter, so as to not interfere with the flow of air to the surrounding air jets 42 spaced 1 inch apart, and set in a 5"×5" grid.

While the dimensions of the game may be varied greatly depending on the type of game involved and the scale employed, for a 20"×44" game, the duct 46 is preferably about 5 inches in diameter; the air jets 42, about 0.040 inch in diameter and set in a 1"×1" grid; and the projections 60, about ½ inch in diameter and set in a 5"×5" grid. The walls of the plenum (that is, the top layer 30 and bottom layer 32) are preferably about 0.08–0.10 inch in thickness.

Figure 4:
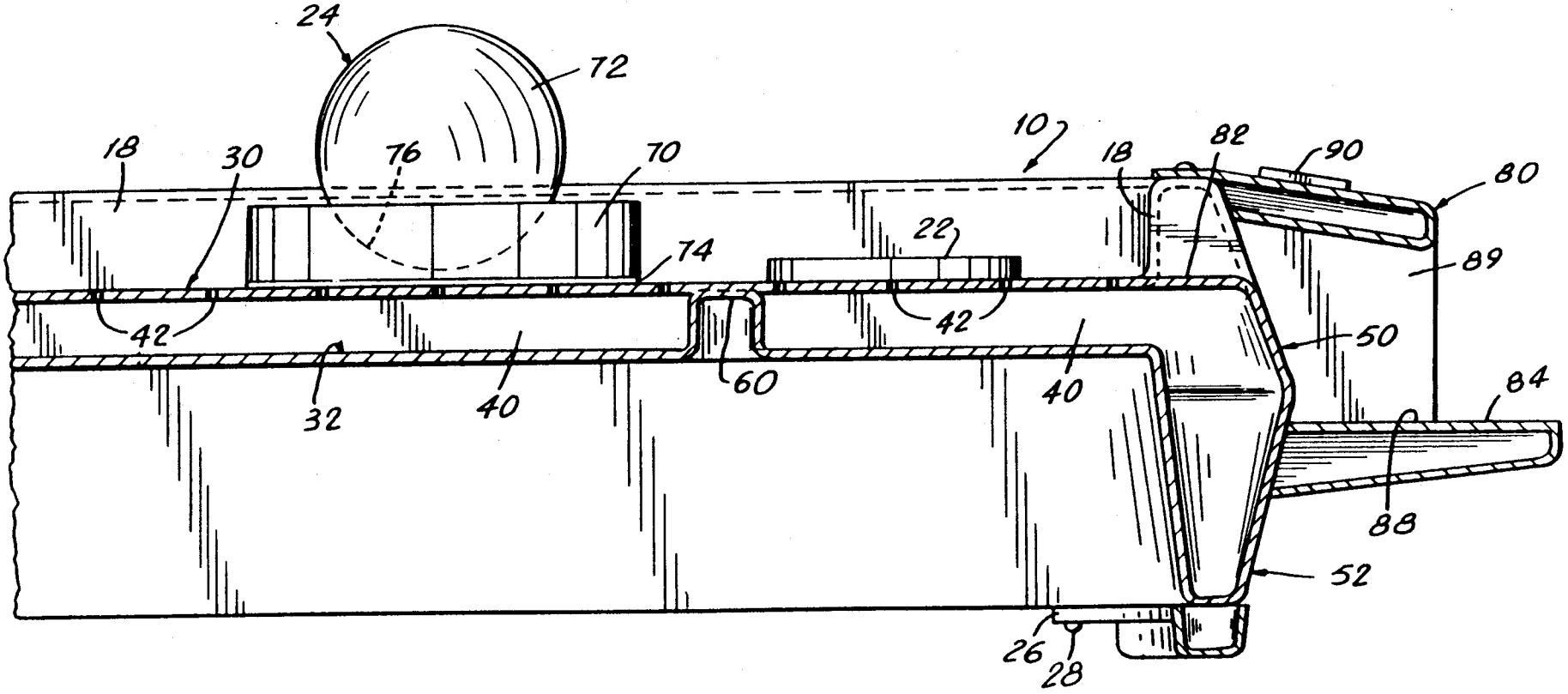
FIG. 4 is a fragmentary sectional view of the game, taken along the line 4—4 of FIG. 2.

Referring now to FIG. 4 as well, in order to define at each end of the playing surface 14 a goal 80 for receipt of the Puck 22, the top layer 30 defines at each end of the playing surface 14 a flat or interruption 82 in the bumper strip 18 so that a puck 22 sliding over the playing surface 14 can smoothly pass off the playing surface 14 through the flush flat 82. A separately formed goal frame 84 (typically injection molded) is secured to the top layer 30—for example, by screws 86—and defines a pocket 88, typically below the level of playing surface 14, to receive a puck 22 which has passed through the flat 82, and a hand opening 89 through which a player can easily remove the puck 22 from the pocket 88 after a goal is scored in order to put the puck 22 in play again. If desired, the goal 80 may additionally include means for keeping track of the number of goals scored, such as a movable pointer or slide 90, the position of the pointer or slide 90 relative to numerical indicia thereabout indicating the number of goals scored by one side.

The entire air bed 12—including the plenum 40, the bumper strip 18 and the projections 60—is formed in a single simple, rapid and economical blow molding operation. The resultant air bed 12 is thus of one-piece integral construction, all formulated from the same plastic material. As blow molding is a well recognized molding technique, familiar to those skilled in the molding art, it is not deemed necessary to provide further details thereof herein.

After the end of the blow molding operation, and after the plastic has cooled below its softening point or forming temperature (e.g., 170°–190° F.), but while the plastic is still in the mold and above room temperature (typically at a temperature of 130°–150° F.), the air jets 42 are die cut through the top layer 30 and the duct 46 is die cut through the bottom layer 32. For example, the upper and bottom halves of the mold may be equipped with respective extendible die punches which are lowered through the top layer 30 and raised through the bottom layer 32 to form the air jets 42 and duct 46, respectively, after these layers 30, 32 have cooled below the forming temperature of the plastic but before they have cooled to room temperature. If desired, however, the forming of air jets 42 or duct 46 or both may be performed after removal of the plastic from the mold, e.g., by punching or router cutting, respectively. Finally, the plastic is removed from the mold, the external legs 26 are secured to the integral legs of the bottom layer curve 52, the fan 16 is secured to the bottom layer 32 about the duct 46, and the goal frames 84 are attached to the top layer 30.

Thus the manufacturing process is simple, rapid and economical, with the entire air bed 12 being a unitary, integral, one-piece construction formed of a single material in a single molding operation, without any need for skilled labor to carefully assemble separate air bed components together to prevent leakage from the plenum 40 and appropriately position the bumper strip 18 relative to the playing surface 14. As the projections 60 and curves 50, 52 of the plenum provide rigidity to the structure, separate rigidifying elements are not required to be added thereto. Optionally bottom layer 32 may be blow molded with rigidifying ribs for providing additional rigidity to the plenum. The resultant air bed, being of one-piece integral unitary construction, is extremely sturdy and highly resistant to damage during normal use and even abuse.

In order to insure that the air escaping through the various air jets 42 is at the same velocity, regardless of the distance of the particular air jet 42 from the duct 46, the vertical spacing between the bottom surface of the upper layer 30 and the upper surface of the bottom layer 32 may be varied so as to compensate for the loss of air volume reaching the further air jets 42 relative to the nearer air jets 42. To this end, if the duct 46 is disposed in the center of the bottom layer 32, as illustrated, the lower surface of the upper layer 30 or the upper surface of the bottom layer 32 (and, indeed the entire bottom layer 32) may be concave so that the vertical spacing adjacent the peripheral air jets 42 is less than the vertical spacing adjacent the more central air jets 42, thereby to compensate for the loss of air volume intermediate the central and peripheral air jets and thus maintain a constant air velocity through all of the air jets 42 and thereby a uniform air cushion over the playing surface 14.

The puck 22 is typically a flat circular disc, preferably made of a high-density thermoplastic, e.g., high impact polystyrene or polypropylene. With a diameter of three inches and a thickness of one-quarter inch, the weight of the puck 22 will be supported by at least four air jets 42 at all times.

The bat 24 is typically formed basically of a bat body 70 and a handle 72 fastened atop the bat body 70. The bat body 70 is a thick disc, preferably of a high-density thermoplastic, such polyethylene, covered on the bottom with a thin layer of felt 74 to avoid scarring of the playing surface 14 of the air bed 12. The top of the bat body 70 is dished as at 76 primarily for two reasons: first, to lower the center of gravity of the bat by lowering the handle portion, and second, to provide protection for the fingers of the player. The spherical handle 72, such as a billiard ball, is attached to the center of the bottom of the bat body 70 at 76 as by a screw (not shown) extending up through the bottom of bat body 70 and into the handle 72. This configuration lowers the center of gravity of the billiard ball-like handle 72 and the point of application of any force which may be exerted by the contestant's hand to a level closest to the level of the center of gravity of the puck 22 to minimize the "tuck" effect i.e., the vertical striking edge of the bat body 70 tucking under the puck 22 so that under impact the puck takes off from the air bed 12 and leaves the table 10. The thickness of the bat body 70 (i.e. the height of its vertical side face) should be at least twice the thickness of the puck 22 and slightly greater than the height of any goal opening in order to avoid any possibility of the bat body 70 sliding under the puck 22, permitting the puck 22 to strike the hand of the contestant holding the handle 72, and preventing the bat body 70 from being caught in the goal. In a preferred embodiment, the height of the vertical side face of the bat body 70 is approximately one inch, and the thickness of the puck 22 is approximately one-quarter inch.

It is important that the sides of the puck 22, bat 24, and bumper strip 18 be as nearly mutually vertical as feasible to avoid imparting to the puck 22 an angle of attack which causes it to leave the playing surface 14. Further, in order to provide the contestant with a feeling of solid contact when hitting the puck, and further to avoid any tucking or other reactive movement of the bat upon contact with the puck, it has been found most advantageous to use a bat-to-puck weight ratio of approximately 10-to-1.

During play of the game, a puck 22 slides virtually friction free across the playing surface 14 of the air cushion table 10. Contestants (not shown), standing at opposite end of the table 10, slide their bats 24 across the playing surface 14 and attempt to knock the puck 22 into the opponent's goal. Each player attempts to score by sliding his bat 24 into the puck 22 so as to knock it either directly into the opponent's goal or bank it off of the bumper strip 18 into the opponent's goal. The puck 22 moves very fast when solidly hit and, unless intercepted off center by the opposer's bat 22, will quickly return to the striking player's end of the table. This high speed rebound action by the puck tends to force the contestants alternately into offensive and defensive roles for brief periods of time depending upon who has gained the control of the puck.

Turning now to the novel aspects of the table game component of the present invention, and referring now to FIGS. 1–4 in particular, the playing surface 14 defines an aperture 100 (see FIGS. 3 and 8) extending therethrough wherever a powered spinning deflector generally designated 150 may be positioned. While there may be several deflectors 150 and thus several apertures 100 on a given playing surface 14, as illustrated there is but a single deflector 150 centrally positioned on the playing surface 14 and thus there is but a single playing surface aperture 100 centrally located in the playing surface 14, directly over the fan 16 and duct 46. Preferably the playing surface aperture 100 has a diameter of about 1 inch or less so that the puck 22 cannot enter into the aperture and the aperture presents only a minimal interference with the creation of a uniform air cushion over the playing surface 14.

A rotatable drive means 102 is disposed below the level of the playing surface 14 in vertical alignment with playing surface aperture 100 so as to enable the drive means 102 to be accessed through the playing surface aperture 100. The drive means 102 is independently rotatable in the sense that it is not manually rotated by either of the players, and its rotation is preferably not under the control of either player during play of the game. As illustrated, the drive means 102 is rotatable continuously in a given direction, but it will be appreciated that, if desired, the drive means 102 can be made to pulse or oscillate through an arc of less than 360° by appropriate mechanical or electromechanical linkages of the type well known to those skilled in the art. At least the upper portion of the drive means 102 is preferably a non-circular or keyed spindle, such as the illustrated D-shaped spindle.

The drive means 102 is rotated by a motor 104 which, in the air cushion game embodiment illustrated, is conveniently and economically the motor of fan 16, but may optionally be a different motor. Obviously if the table game component 10 is not an air cushion table game, there will be no fan 16 and thus a motor 104 will have to be specially provided. Where there are a plurality of drive means 102, each such drive means may have a separate motor 104 or the plurality may be commonly driven by a single motor. Each drive means 102 is preferably provided with a fly wheel 110 to increase its inertia and thereby assist it in maintaining a constant speed of rotation even when such rotation meets resistance. Mechanical linkage between the motor 104 and the drive means 102 is effected by means of a conventional clutch arrangement with a first clutch plate 112 being disposed at the base of the drive means 102 and the opposed second clutch plate 114 being disposed at the top of the shaft 116 of motor 104. The clutch plates 112, 114 forming the mechanical linkage between the drive means 102 and motor 104 are formed of an electrically insulative material for reasons of electrical safety. For mechanical safety reasons both clutch plates 112, 114 are at least partially disposed in a recess within the apertured top 120 of the housing of motor 104 (here, also the top of the fan 16).

In order to isolate aperture 100 and drive means 102 from the plenum 40, so that there is not a current of air driving upwardly through the playing surface aperture 100 when the game is in play, a deflector assembly housing 122 made of non-porous material is disposed in vertical alignment with playing surface aperture 100 and in gas-tight, sealing relationship with both the lower surface of the top layer 30 and the upper surface of the motor housing 120. The deflector assembly housing 122 tapers inwardly from the bottom portion to the top portion so that the top surface thereof does not extend outwardly much beyond the diameter of the playing surface aperture 100 and thereby blocks as little as possible communication between the plenum 140 thereabout and the air jets 42 extending through top layer 30. The bottom portion of the deflector assembly housing 122 is typically wider than its top portion to accommodate the fly wheel 110 and clutch plates 112, 114. The deflector assembly housing 122 is mounted on the upper surface of the motor housing 120, as by screws 124, for movement therewith as a unit and to effect a gas-tight sealing relationship therebetween. The deflector assembly housing 122 is configured and dimensioned such that when the motor housing 120 is assembled onto the bottom layer 32 of plenum 40 in a gas-tight sealing relationship, the upper surface of the deflector assembly housing 122 enters into the desired gas-tight sealing relationship with the top layer of plenum 40. If necessary, gaskets (not shown) may be employed in order to effect the desired gas-tight sealing relationships.

Preferably the deflector assembly housing 122 additionally includes a plurality of lower locating ribs 126 and upper locating ribs 128 extending inwardly in order to assist in maintaining the drive means 102 in its desired vertical orientation. The upper positioning ribs 128 preferably extend continuously circumferentially about the drive means 102 to minimize the entry of dust and the like into the chamber 130 defined by the interior of deflector assembly housing 122.

Figure 3A:
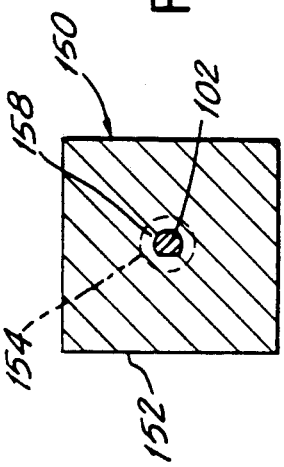
FIG. 3A is a sectional view of the first deflector taken along the line 3A—3A of FIG. 3.

The kit of the present invention includes, in addition to the table game component 10 described hereinabove, at least one component adapted to be removably positioned in the playing surface aperture 100. Referring now in particular to FIGS. 3 and 3A, the one essential removable component of the kit is a rotatable deflector generally designated 150. When the deflector 150 is positioned in the playing surface aperture 100, it has a deflecting portion 152 of a first given composition, size and configuration positioned above the playing surface 14 for deflecting the movement of the puck 22 when the deflecting portion 152 contacts the puck 22, and a driving portion 154 disposed below the playing surface 14 for operatively engaging the drive means 102.

As illustrated, the deflecting portion 152 is of a high density polyethylene, high impact polystyrene or polypropylene, is of square configuration, and is about $2\times2\times\frac{1}{4}$ inch in size. Alternatively, the deflecting portion 152 may be formed of other compositions (including wood), may have different configurations (whether regular or irregular), and may be of greater or lesser dimensions (although preferably always having dimensions such that it completely covers the playing surface aperture 100). The composition of the deflecting portion is selected to provide the desired puck rebound speed, a soft, more impact absorbing composition slowing the rebound and a harder, more resilient composition accelerating the rebound. The size of the deflecting portion (and more particularly its cross sectional dimensions) is selected to provide the desired level of difficulty to the player seeking to bypass the deflector, a larger deflecting portion being harder to avoid than a smaller deflecting portion. The configuration of the deflecting portion is selected to provide the desired level of randomness, certain configurations providing more spin to the puck 22 and less predictable rebounds of the puck 22 than others, as easily determined for any configuration with a minimum of experimentation.

The driving portion 154 is configured and dimensioned to rotate easily within the playing surface aperture 100 and to operatively engage with the driving means 102 for rotation thereby. As illustrated, the driving portion 154 includes an axially extending hollow key-receiving channel 158 of D-shape cross section, open at the bottom end and configured and dimensioned to receive the D-shaped upper portion of the drive means 102 for rotation therewith and thereby. It will be appreciated that substantially the same results may be obtained by providing the driving means 102 with a key-receiving interior channel open at the top and using a key-shaped solid driving portion 154 configured and dimensioned to be engagingly received by the driving means channel for rotation thereby and therewith.

The D-shaped channel 158 may have a top portion which rests on the top portion of the drive means 102 to position the deflecting portion 152 above the playing surface 14 or, alternatively, the bottom of the driving portion 154 may rest upon the upper surfaces of the upper positioning ribs 128 of deflector assembly housing 122 in order to maintain the deflecting portion 152 spaced above the playing surface 14. If preferred, both the upper positioning ribs 128 and the top of the drive means 102 may serve cooperatively together to properly position the deflecting portion 152 above the playing surface 14.

The deflector 150, including the deflecting portion 152 and the driving portion 154, is preferably of unitary one-piece integral construction. Preferably the deflector 150 is of injection molded lightweight plastic to minimize the load on motor 104. Deflector 150 is easily engaged with the drive means 102 or disengaged therefrom by a simple manual displacement along the common vertical axis, by telescopic motion in order to engage the deflecting portion 154 and the drive means 102 and a reverse telescopic motion to disengage the two.

Figures 5, 5A:
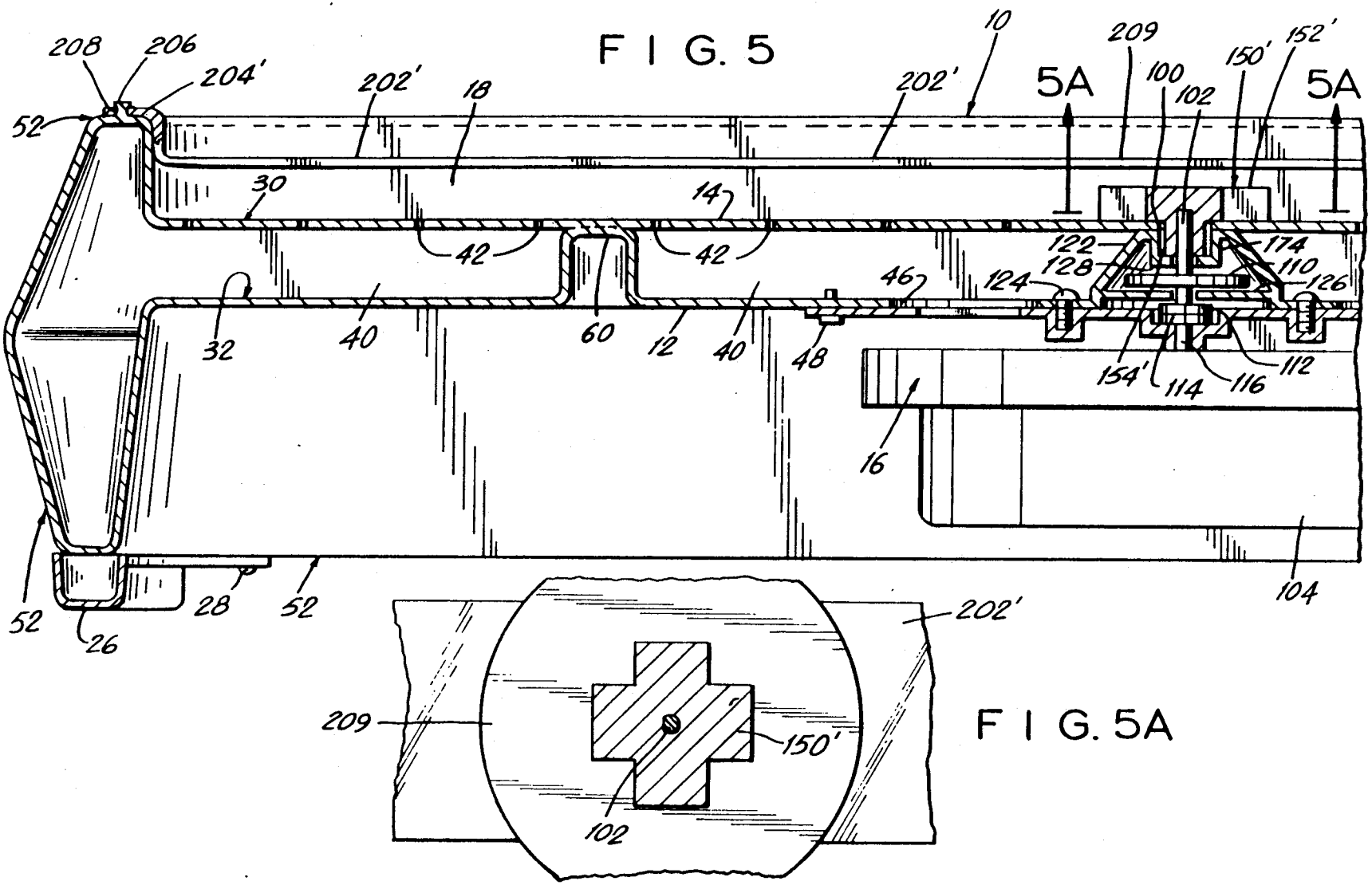
FIG. 5 is a fragmentary sectional view of the game, similar to FIG. 3 but with an alternate deflector in place.
FIG. 5A is a sectional view of the alternate deflector and concealing member taken along the line 5B—5B of FIG. 5.

Referring now to FIG. 5, therein illustrated is another removable deflector generally designated 150', similar to deflector 150, but with a deflecting portion 152' of different composition, size or configuration. As illustrated, the deflector 150' has a deflecting portion 152. made of a different, stiffer plastic than deflecting portion 152, in the configuration of a cross (rather than a square), with arms of greater reach than the corners of deflecting portion 152. The driving element 154' of deflector 150' is similar to the driving element 154 of deflector 150 in size and configuration and thus serves the same function.

Figure 3B:
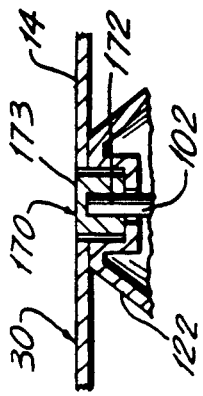
FIG. 3B is a fragmentary sectional view of the game with a plug in place.

As noted above, the playing surface aperture 100 is preferably configured and dimensioned to prevent entry thereinto of the puck 22 and to minimize interference with the formation of the air cushion above the playing surface 14. Referring now to FIG. 3B, where the playing surface aperture 100 is larger than this, however, or simply for aesthetic reasons, it is desirable to provide, as one of the components adapted to be removable positioned in the playing surface aperture 100, a plug generally designated 170. The plug 170 defines an internal channel 172, open at the bottom thereof, which is preferably configured and/or dimensioned so that it does not operatively engage with drive means 102 for rotation thereby and therewith. Thus the channel 172 is preferably cylindrical, rather than eccentric or D-shaped, and of greater diameter than the upper portion of drive means 102. If desired, the circumference of the plug 170 may also be such as to frictionally engage with portions of the upper positioning ribs 128 thereabout so as to restrain rotation of the plug 170 with drive means 102. When plug 170 is removably positioned within playing surface aperture 100, the top surface 173 of plug 170 is flush with the playing surface 14 and stationary so as to present minimal interference with the passage of a puck 2 thereover. If desired, finger nail-receiving recesses or other means for facilitating removal of the plug 170 from the playing surface 14 of the table game component 10 are provided. In any case, the table game component 10 may be inverted to facilitate removal of plug 170 therefrom.

Figure 8:
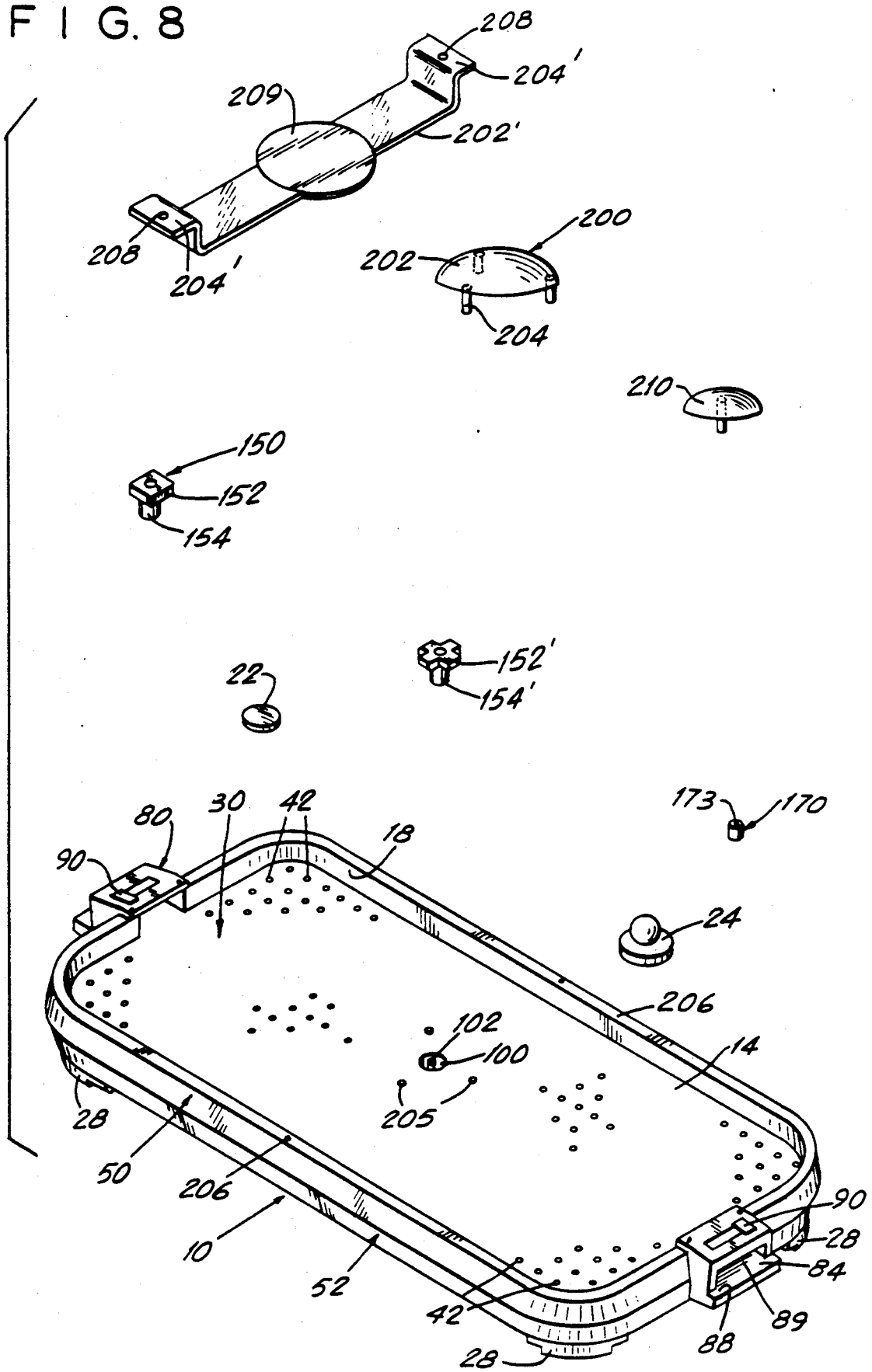
FIG. 8 is an isometric view, in reduced scale, of the several components of one embodiment of a kit according to the present invention.

It will be appreciated that, as illustrated in FIG. 8, a kit according to the present invention will contain as a component to be removably positioned in the playing surface aperture 100 at least one deflector 150, and optionally one or more additional deflectors 150' (varying in composition, size or configuration), a plug 170, or both. Thus the kit permits the table game component 10 to be played with varying levels of difficulty and randomness, either without a deflector or with a deflector suited to the particular level of skill of the contestants. Even where the different deflectors 150, 150' present equal levels of difficulty and randomness, the replacement of one deflector by another deflector slightly modifies the game so as to retain interest therein by requiring slightly modified skills. It will be understood that a reference herein to the use of deflectors of different composition, size and configuration does not imply that the deflectors differ in each of these three respects as a change any one of these respects may effectively modifies the nature of play of the game.

To further add mystery and randomness to the game and to further increase its level of difficulty, the kit of the present invention may additionally include a concealing component 200, 200' for concealing the deflecting portion 152, 152' or even the plug upper surface 174 from the view of the players during normal play of the game.

Referring now to FIGS. 6 and 6A in particular, the concealing component 200 comprises an umbrella- or dome-shaped cover 202 and support legs 204 depending from the cover 202 for removably positioning the cover 200 over and about the deflecting portion 152, 152' (or plug upper surface 173) when the deflector 150, 150' (or plug 170) is removably positioned in the playing surface aperture 100. As illustrated, the support legs 204 are located, configured and dimensioned to support the cover 202 above the playing surface 14 (and more particularly above the deflecting portion thereon) without the cover 202 contacting the playing surface 14 (or the deflecting portion 152, 152' thereon). The cover 202 is opaque (or at least translucent) and configured and dimensioned to conceal from view even the largest of the deflecting portions 152, 152' provided in the kit. The cover 202 need not extend much beyond the largest of the deflecting portions 152, 152' in order to Perform this function. The bottom ends of the support legs 204 are positioned so that they can be received intermediate air jets 42 without blocking any of the air jets. The playing surface 14 may be provided with slight indentations or recesses 205 to receive the bottom ends of support legs 204 to secure them against accidental displacement—for example, if the cover 200 or its legs 200 are hit by a puck 22 or bat 24—while still enabling easy removal of the cover 200 from the table game component 10.

Referring now to FIGS. 5 and 5A in particular, the concealing component 200' comprises a elongated, generally planar cover 202' and support flanges 204 extending axially from each end of the cover 202 . The cover 202' is similar to the cover 202 except that it is generally flat and extends fully across the width of the playing surface 14, and the support flanges 204' are similar to the support legs 204 except that they removably position the cover 202' above the playing surface 14 and its aperture 100 without directly contacting the playing surface 14 themselves. Thus, as illustrated, the flanges 204' rest on the upper surface of the bumper strip 18 (that is, the peripheral curve 50 of the top layer 30). The width of the cover 202 is sufficient to conceal from the view of the players during normal play of the game the largest of the deflecting portions 152, 152 provided in the kit. The cover 202' may be opaque or translucent throughout or, as illustrated, may be opaque or translucent only in a central portion 209 thereof over and about the deflecting portion 152, and transparent elsewhere to minimize unnecessary concealment of the playing surface 14. The support flanges 204' maintain the cover 202' slightly spaced above the top of both the deflecting portion 152, 152' and the puck 22 so as not to interfere with the operation of either. While the vertical spacing between the cover 202' and playing surface 14 enables passage of a puck 22 therebetween, in the event that a puck 22 stops under the cover 202', it may easily be displaced therefrom—for example, using a bat 24, a finger or a thin rod. If desired, the support flanges 204' may be removably mounted on the bumper strip 50 to lock it against accidental displacement therefrom—for example, by pins or lugs 206 molded into and extending upwardly from the curve 50 of the top layer 30 and entering into apertures 208 in the support flanges 204'.

Referring now to FIGS. 7 and 7A in particular, while both of the concealing components 200, 200' described hereinabove are stationary during play of the game, the deflector 150, 150' may itself include concealing means, such as an opaque or translucent umbrella or dome-like cover portion 210 positioned above and about its deflecting portion 152, 152'. When the deflector is removably positioned in the Playing surface aperture 100, the cover portion 210 conceals the deflecting portion 152, 152 from the view of the players during normal play of the game. Preferably the cover portion 210 of each deflector 150, 150 is similar in appearance so that the players cannot determine the particulars of the deflecting element thereunder during normal play of the game. Each cover portion 210 is preferably removable from the deflector 150, 150', and, in that case, a single common cover portion may be used for each deflector (and even for plug 170) adapted to receive the cover portion 210, as shown in FIG. 8.

Referring now to FIG. 8, therein illustrated is a kit according to the present invention including a table game component 10, a plug 170, a pair of deflectors 150, 150', and a pair of concealing components 200, 200', and a cover portion 210 insertable into the deflectors or plug.

To summarize, the present invention provides a kit for forming a table game in which there is a removable powered rotating deflector so that the game may be played with or without the deflector. The kit may include a plurality of interchangeable removable components for varying the level of difficulty and randomness of the game, including a variety of different deflectors and also plug means for providing a flush playing surface when all deflectors have been removed from the playing surface of the game. The kit may additionally include concealing components for concealing the deflector in use from the view of the players during normal play of the game, thereby adding a further element of randomness and mystery.

Now that the preferred embodiments of the present invention have been shown and described in detail, various modifications and improvements thereon will become readily apparent to those skilled in the art. Accordingly, the appended claims are to be construed broadly and in a manner consistent with the spirit and scope of the invention described herein.

I claim:

1. A kit comprising in combination:

(A) a table game component including (i) a playing surface defining an aperture therethrough, (ii) rotatable drive means disposed below said playing surface and accessible through said aperture, (iii) a game piece capable of moving over said playing surface, and (iv) means for engaging said game piece so as to cause it to move over said playing surface;

(B) at least one component adapted to be positioned in said aperture, said at least one component comprising rotatable deflector means having, when positioned in said aperture, a deflecting element of a first given composition, size and configuration positioned above said playing surface for deflecting the movement of said game piece when said deflecting element contacts said game piece, and a driving element disposed below said playing surface for operatively engaging said drive means for rotation therewith; and (C) a concealing component comprising means for concealing said deflecting element from the view of the players during normal play of the game.

2. The kit of claim 1 wherein said concealing means includes support means for removably positioning it over and about said deflecting element of said at least one component, when said at least one component is removably positioned in said aperture.

3. The kit of claim 2 wherein said concealing component includes support means for removably supporting it on said playing surface.

4. The kit of claim 2 wherein said concealing component includes support means for supporting it above said playing surface without contacting said playing surface.

5. The kit of claim 1 wherein said deflector means additionally includes said concealing component positioned above and about said deflecting element of said deflector means, when said deflector component is positioned in said aperture, so as to conceal said deflecting element from the view of the players during normal play of the game.

6. A kit comprising in combination:

(A) a table game component including (i) a playing surface defining an aperture therethrough, (ii) player-independent rotatable drive means disposed below said playing surface and accessible through said aperture, (iii) a game piece capable of moving over said playing surface, and (iv) player-controlled means for engaging said game piece so as to cause it to move over said playing surface;

said table game component being an air cushion table game including an air bed having an upper surface defining said playing surface and means for creating an air cushion above said playing surface, said game piece having an area and weight such that it floats upon said air cushion during play and is capable of moving over said playing surface generally without touching it, and said engaging means engaging said game piece so as to cause it to move upon said air cushion and over said playing surface; and (B) at least one component adapted to be removably positioned in said aperture, said at least one component comprising rotatable deflector means having, when removably positioned in said aperture, a deflecting element of a first given composition, size and configuration positioned above said playing surface for deflecting the movement of said game piece when said deflecting element contacts said game piece, and a driving element disposed below said playing surface for operatively engaging said drive means for rotation therewith.

7. A kit comprising in combination:

(A) a table game component including (i) a playing surface defining an aperture therethrough;

(ii) rotatable drive means disposed below said playing surface and accessible through said aperture, (iii) a game piece capable of moving over said playing surface, and (iv) means for engaging said game piece so as to cause it to move over said playing surface;

said table game being an air cushion table game including an air bed having an upper surface defining said playing surface and means for creating an air cushion above said playing surface, said game piece having an area and weight such that it floats upon said air cushion during play and is capable of going over said playing surface generally without touching it, and said engaging means engaging said game piece so as to cause it to move upon said air cushion and over said playing surface; and (B) at least one component adapted to be positioned in said aperture, said at least one component comprising rotatable deflector means having, when positioned in said aperture, a deflecting element of a first given composition, size and configuration positioned above said playing surface for deflecting the movement of said game piece when said deflecting element contacts said game piece, and a driving element disposed below said playing surface for operatively engaging said drive means for rotation therewith;

said means for creating an air cushion above said playing surface also comprising said drive means, said deflector means being rotated by said cushion-creating means through a mechanical clutch linkage.

8. A kit comprising in combination:

(A) an air cushion table game component including (i) an air bed having an upper surface defining a playing surface with an aperture therethrough, (ii) means for creating an air cushion above said playing surface, (iii) drive means rotating continuously throughout game play disposed below said playing surface and accessible through said aperture, (iv) a game piece and having an area and weight such that it floats upon said air cushion during play and is capable of moving over said playing surface generally without touching it, (v) means for engaging said game piece so as to cause it to move upon said air cushion and over said playing surface; and (B) a plurality of components adapted to be removably positioned in said aperture, including (i) rotatable deflector means having, when removably positioned in said aperture, a deflecting element of a first given composition, size and configuration positioned above said playing surface for deflecting the movement of said game piece when said deflecting element contacts said game piece, and a driving element disposed below said playing surface for operatively engaging said drive means for rotation therewith;

(ii) second rotatable deflector means having, when removably positioned in said aperture, a deflecting element of a second given composition, size and configuration, different in at least one respect from said first given composition, size and configuration, positioned above said playing surface for deflecting the movement of said game piece when said deflecting element contacts said game piece, and a driving element disposed below said playing surface for operatively engaging said drive means for rotation therewith; and (iii) plug means having, when removably positioned in said aperture, a stationary top surface substantially flush with said playing surface.

9. A kit comprising in combination:

(A) an air cushion table game component including (i) an air bed having an upper surface defining a playing surface with an aperture therethrough, (ii) means for creating an air cushion above said playing surface, (iii) rotatable drive means disposed below said playing surface and accessible through said aperture, (iv) a game piece and having an area and weight such that it floats upon said air cushion during play and is capable of moving over said playing surface generally without touching it, (v) means for engaging said game piece so as to cause it to move upon said air cushion and over said playing surface;

(B) a plurality of components adapted to be removably positioned in said aperture, including (i) a rotatable deflector means having, when removably positioned in said aperture, a deflecting element of a first given composition, size and configuration positioned above said playing surface for deflecting the movement of said game piece when said deflecting element contacts said game piece, and a driving element disposed below said playing surface for operatively engaging said drive means for rotation therewith;

(ii) second rotatable deflector means having, when removably positioned in said aperture, a deflecting element of a second given composition, size and configuration, different in at least one respect from said first given composition, size and configuration, positioned above said playing surface for deflecting the movement of said game piece when said deflecting element contacts said game piece, and a driving element disposed below said playing surface for operatively engaging said drive means for rotation therewith; and (iii) plug means having, when removably positioned in said aperture a stationary top surface substantially flush with said playing surface; and (C) a concealing component comprising means for concealing said deflecting element of one of said deflector means from the view of the players during normal play of the game, said concealing means including support means for positioning it over and about said deflecting element when said one deflector means is positioned in said aperture.

10. The kit of claim 9 wherein said concealing component is mounted on said deflector means for rotation therewith as a unit.

11. The kit of claim 9 wherein said concealing component, when in use, is disposed at least partially above said deflector means and extends substantially laterally outwardly thereof.

12. A game device comprising in combination:

(A) a table game component including (i) a playing surface, (ii) a game piece capable of moving over said playing surface, and (iii) means for engaging said game piece so as to cause it to move over said playing surface;

(B) rotatable deflector means including a deflecting element positioned above said playing surface for deflecting the movement of said game piece when said deflecting element contacts said game piece, and a driving element for rotating said deflecting element; and (C) a concealing component including means for concealing said deflecting element from the view of the players during normal play of the game, and support means for positioning said concealing means over and about said deflecting element.

13. The game device of claim 12 wherein said support means supports said concealing component on said playing surface.

14. The game device of claim 12 wherein said support means supports said concealing component above said playing surface without contacting said playing surface.

15. The game device of claim 12 wherein said support means removably positions said concealing component relative to said playing surfaces.

16. The game device of claim 12 wherein said concealing component is mounted on said deflector means for rotation therewith as a unit.

17. The game device of claim 12 wherein said concealing component, when in use, is disposed at least partially above said deflector means and extends substantially laterally outwardly thereof.

18. A kit comprising in combination:

(A) a table game component including (i) a playing surface defining an aperture therethrough, (ii) player-independent rotatable drive means disposed below said playing surface and accessible through said aperture, (iii) a game piece capable of moving over said playing surface, and (iv) player-controlled means for engaging said game piece so as to cause it to move over said playing surface;

(B) at least one component adapted to be removably positioned in said aperture, said at least one component comprising rotatable deflector means having, when removably positioned in said aperture, a deflecting element of a first given composition, size and configuration positioned above said playing surface for deflecting the movement of said game piece when said deflecting element contacts said game piece, a driving element disposed below said playing surface for operatively engaging said drive means for rotation therewith; and a concealing element mounted on said deflector means for rotation therewith as a unit.

19. The kit of claim 18 wherein said concealing element, when in use, is disposed at least partially above said deflector means and extends substantially laterally outwardly thereof.

* * * * *